US006223710B1

(12) United States Patent
Franz

(10) Patent No.: US 6,223,710 B1
(45) Date of Patent: May 1, 2001

(54) BUILT-UP PISTON

(75) Inventor: Holger Franz, Baltmannsweiler (DE)

(73) Assignee: Mahle GmbH, Stuttgart (DE)

( * ) Notice: Subject to any disclaimer, the term of this patent is extended or adjusted under 35 U.S.C. 154(b) by 0 days.

(21) Appl. No.: 09/284,229

(22) PCT Filed: Aug. 19, 1997

(86) PCT No.: PCT/DE97/01799

§ 371 Date: Apr. 9, 1999

§ 102(e) Date: Apr. 9, 1999

(87) PCT Pub. No.: WO98/16731

PCT Pub. Date: Apr. 23, 1998

(30) Foreign Application Priority Data

Oct. 12, 1996 (DE) ..... 196 42 109

(51) Int. Cl.[7] ..... F02F 3/00
(52) U.S. Cl. ..... 123/193.6
(58) Field of Search ..... 123/193.6; 92/216, 92/220, 221

(56) References Cited

U.S. PATENT DOCUMENTS

| | | | | |
|---|---|---|---|---|
| 1,548,329 | * | 8/1925 | Nelson | 92/220 |
| 2,059,713 | * | 11/1936 | Schneider | 92/220 |
| 2,104,347 | * | 1/1938 | Larkin | 92/220 |
| 3,323,503 | | 6/1967 | Grosshans . | |
| 3,465,651 | * | 9/1969 | Tromel | 92/220 |
| 3,915,141 | * | 10/1975 | Ottl et al. | 123/193.6 |
| 4,083,292 | | 4/1978 | Goloff . | |
| 4,433,616 | * | 2/1984 | Hauser | 92/220 |
| 4,517,930 | | 5/1985 | Nakano | 123/193.6 |
| 4,532,686 | * | 8/1985 | Berchem | 92/220 |
| 4,603,617 | * | 8/1986 | Barth et al. | 92/220 |

FOREIGN PATENT DOCUMENTS

| | | |
|---|---|---|
| 38 30 033 | 6/1989 | (DE) . |
| 0 731 268 | 9/1996 | (EP) . |

* cited by examiner

*Primary Examiner*—Marguerite McMahon
(74) *Attorney, Agent, or Firm*—Collard & Roe, P.C.

(57) ABSTRACT

The invention concerns a built-up piston (1) with an upper part (2) made of an iron material and a lower part (3) made of an aluminum alloy. The object of the invention is to increase the loading capacity of the bosses. To that end, the lower part (3) comprises cast-iron or steel gudgeon pin bosses (4) which are screwed at lest to the lower part (3).

5 Claims, 1 Drawing Sheet

BUILT-UP PISTON

The invention relates to a built-up piston as defined in the introductory part of claim 1.

A corresponding piston with a lower part made from an aluminum material is known from U.S. Pat. No. 4,517,930. The development in connection with such pistons is in the direction of ignition pressures of more than 150 bar. As the ignition pressure load increases, the load acting on the gudgeon pin bosses is found to be excessively high and may lead to initial fissuring of the bosses and cracks in the supporting elements. This problem has been solved heretofore by manufacturing the lower part from an iron material as well, whereby a piston cast in one single piece from grey cast iron is then employed as well, if need be.

The drawback of said solution is that the weight advantage gained by the use of aluminum materials is dispensed with.

The invention, therefore, deals with the problem of increasing in connection with a piston of the type specified above the strength of the bosses and supports as well as the strength within the region of the screwed joint while keeping the weight of the piston low.

Said problem is solved in connection with pistons of said type by the design according to the characterizing features of claim 1 or 2. Advantageous further developments are the objects of the depending claims.

Since with the solution as defined by the invention only the region of the bosses and, if need be, of the boss supports are made of iron material, said regions being highly stressed in terms of strength, whereas the shaft and the bottom of the lower part absorbing the forces from the head of the piston, however, continue to consist of an aluminum-based material, the piston has, combined with a highly improved loading capacity of the bosses, a lower weight than a comparable piston completely consisting of an iron material. The pressure pieces normally used with pistons of this type for admitting the force into the lower aluminum part can be advantageously omitted if, as shown in the exemplified embodiment, the force admitted by the connection screws is introduced in each case in the iron material of the upper part and the bosses and the boss support or connection plates.

If the gudgeon pin bosses screwed to the lower part consist of steel, preferably forged steel is employed. However, cast steel can satisfy the requirements as well.

Furthermore, as compared to pistons with lower parts made from cast iron, advantages are gained also with respect to the required quality controls and in regard to material and casting defects.

Figure 1:
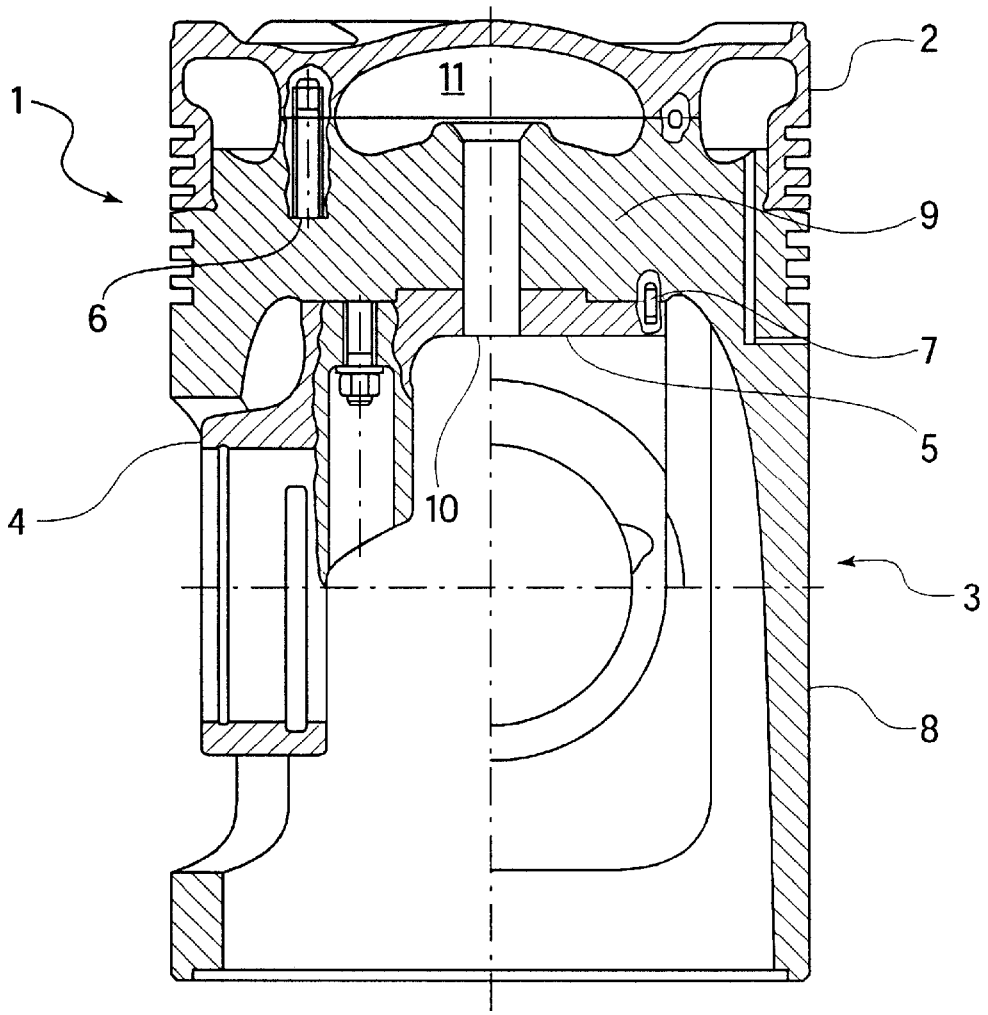

The invention is described in the following on an exemplified embodiment. In the drawing, FIG. 1 shows a cross section through a piston as defined by the invention (on the left in the direction of the gudgeon pin, on the right in the pressure-counterpressure direction).

Figure 2:
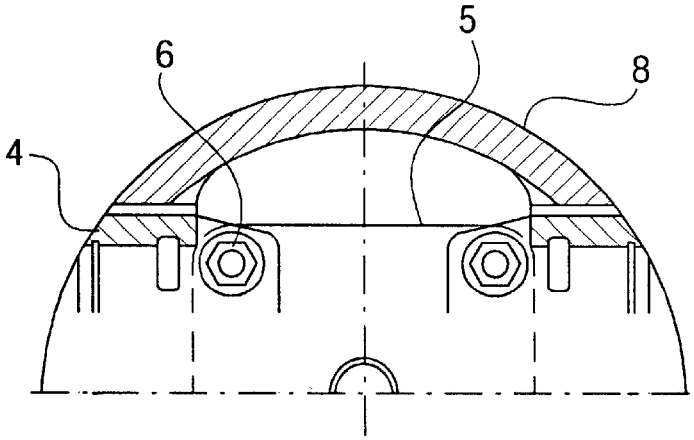

FIG. 2 is a bottom view cut on the level of the axis of the gudgeon pin.

The screw shown at the top on the left is not shown in the drawing in its correct position for the sake of better illustration, but in such a way that it is represented broken open with its real graduated circle.

A built-up piston 1 has an upper steel part 2 and a lower part 3 made from an aluminum-based material. On the lower part 3, the gudgeon pin bosses 4, which were manufactured from an iron material by casting or forging, are mounted with a connecting plate 5 with four screws 6, said connecting plate having been molded on as a single piece. The force of the four screws 6 is admitted in upper steel part 2 and connecting plate 5, whereby the lower part 3 is clamped between the upper steel part 2 and the connecting plate 5. Correct positioning of the upper part 2 relative to lower part 3 and of connecting plate 5 relative to lower part 3 is assured by the fitted pins 7.

As shown in FIG. 1, as connecting plates 5 it is possible to employ one plate forming one single piece with the two bosses 4, or one plate for each boss, i.e., a total of two plates each forming a single piece with the respective boss. The connecting plate or plates in particular facilitate exact positioning of the gudgeon pin bosses relative to the center axis of the piston.

Lower part 3 consists of a shaft 8 and a lower part bottom 9 which, in its center, has cooling oil breakthrough 10 leading to a central cooling chamber 11.

What is claimed is:

1. A built-up piston with an upper piston part made of steel or cast iron, said upper piston part having a cooling chamber with cooling oil, and a lower piston part made of an aluminum-based material and having a shaft and, in its upper region, a bottom at least one support surface for the upper piston part, whereby the lower piston part and the upper piston part are joined with each other by screws that do not penetrate the piston pin, characterized that the piston (1) has gudgeon pin bosses (4) made from cast iron or steel, said gudgeon pin bosses being joined by screwing at least with the lower piston part (3).

2. The built-up piston according to claim 1, characterized in that boss supports made of cast iron or steel are present, said supports forming one piece with the respective gudgeon pin bosses (4).

3. The built-up piston according to claim 1, characterized in that the gudgeon pin bosses (4) are screwed to the upper part (2) and that the force introduced by the screws (6) is admitted into the gudgeon pin bosses (4) of the connecting plate (5) and the upper part (2), so that the lower part (3) of the piston is clamped between the gudgeon pin bosses (4) and the upper part (2).

4. The built-up piston according to claim 1, characterized in that the two gudgeon pin bosses (4) have only one common connecting plate (5), so that the gudgeon pin bosses (4) and the connecting plate (5) form one single piece.

5. The built-up piston according to claim 1, characterized in that the two gudgeon pin bosses (4) each have a connecting plate (5).

* * * * *